US005946758A

United States Patent [19]

Hohlbein et al.

[11] Patent Number: 5,946,758

[45] **Date of Patent: *Sep. 7, 1999**

[54] TOOTHBRUSH HAVING CONTOURING MULTI-COMPONENT HEAD WITH PEEL-RESISTANT JOINT AND LIMITED FLEXIBILITY

[75] Inventors: Douglas J. Hohlbein, West Trenton; Thomas Edward Mintel, Rahway, both of N.J.

[73] Assignee: Colgate-Palmolive Company, New York, N.Y.

[ * ] Notice: This patent is subject to a terminal disclaimer.

[21] Appl. No.: 08/881,740

[22] Filed: Jun. 24, 1997

[51] Int. Cl.[6] ..... A46B 9/04

[52] U.S. Cl. ..... 15/167.1; 15/172

[58] Field of Search ..... 15/167.1, 172

[56] References Cited

U.S. PATENT DOCUMENTS 5,758,383 6/1998 Hohlbein ..... 15/167.1

FOREIGN PATENT DOCUMENTS 648 448 A1 4/1995 European Pat. Off. .
1 657 299 2/1971 Germany .
9402125 2/1994 Germany .
WO 92/17092 10/1992 WIPO .
WO 92/17093 10/1992 WIPO .
WO 96/02165 2/1996 WIPO .
WO 97/07707 3/1997 WIPO .
97/24048 7/1997 WIPO .

*Primary Examiner*—Randall E. Chin
*Attorney, Agent, or Firm*—Henry S. Goldfine; Richard J. Ancel

[57] ABSTRACT

A toothbrush having a bristle-bearing head divided into at least two sections is disclosed. The free end section, when unstressed, is normally biased to assume an angle of about 15° with respect to the other, to thereby define an articulated head. The two sections of the head have facing ends joined by a thin bridge or hinge section integral with the two head sections, the bridge or hinge forming a groove between adjacent head sections. The upper surface of the bridge section is substantially flush with the upper surface of the head (opposite to the bristle-bearing surface). The space between the two facing ends is filled with a soft elastomer of about 5 to about 30, preferably about 13 to about 30 Shore A hardness. This hinge construction defines an articulated head of limited flex motion, wherein, when utilized by the average adult brusher, who applies an average brushing force of 0.5 pounds, flexes to a substantially flattened position. According to a second aspect of the invention, each end of the groove terminates in a flange at its extreme outer edge, and the groove, including the flange, is filled with an elastomer, which, due to the presence of the flange, is resistant to peel stresses caused by flexing of the hinge or joint.

11 Claims, 5 Drawing Sheets

TOOTHBRUSH HAVING CONTOURING MULTI-COMPONENT HEAD WITH PEEL-RESISTANT JOINT AND LIMITED FLEXIBILITY

BACKGROUND OF THE INVENTION

1. Field of the Invention

This invention relates to a toothbrush comprising a handle made of a relatively rigid plastic material and a multi-component toothbrush head, one component of the head being made of the same material as the handle, the other being comprised of an elastomer. The head is resilient and flexible by virtue of being divided into two or more segments. Each segment is linked to an adjacent segment by means of a flexible joint, which comprises a relatively thin integral bridge or hinge, oriented transversely to the longitudinal axis of the brush, made of the same material as the handle and a slot or groove running from the top or bottom surface of the bridge to the top or bottom surface of the brush, respectively, depending on the placement of the bridge. According to one aspect of the invention, each end of the transversely oriented groove terminates in a flange at its extreme outer edge, and the groove and the flange are filled with a soft elastomer. Due to the presence of the elastomer-filled flange, the multi-component joint is resistant to peel stresses, which are caused by flexing of the hinge in such direction that the flanges flex away from each other as the brush head either straightens due to brushing or is forced to assume a convex shape due to the exertion of excessive brushing pressure In another aspect, the front one-half to one-third of the head is predisposed at what has been determined to be a desirable angle, namely 15°, with respect to the rear end of the head, wherein the degree of flex is limited first by the positioning of the bridge such that the upper surface thereof is flush with the upper surface of the head and the groove runs to the bottom or bristle-bearing surface, and second by the selection of elastomers falling within a certain range of Shore A hardness filling the groove.

2. Description of the Prior Art

Toothbrushes with curved or angled bristle tip configurations that offer improved access to hard-to-reach areas such as the lingual surfaces of the front teeth, and behind the rear molars, placing more bristles in contact with the outer surfaces of the front teeth are well known in the art. However, many current brushes which have rigidly mounted bristles and a rigid curved or angled bristle surface exhibit an inherent disadvantage when brushing both flat as well as concave tooth surfaces because placing a curved or angled bristle surface on flat tooth surfaces results in fewer bristles making contact with the teeth. These fewer bristles must support the brushing forces applied through the handle, which will result in premature splaying of the bristles. Some toothbrushes have a "power tip" configuration (elongated rigidly mounted tip bristlcs) which are claimed to have improved access benefit. Such brushes are illustrated in WO 94/09678; GB 304,459; U.S. Pat. No. 1,639,880, and U.S. Pat. No. 4,800,608, the teachings of which are incorporated herein in their entirety.

Thus, while fixed angle heads offer improved access to difficult to reach areas, because of their shortcomings, it would be desirable to have an angled or curved brush head that flexes back to a flattened position when the brush is subjected to typical brushing forces.

Toothbrushes that include heads having pivoting or articulated sections joined together in a variety of constructions, such as by hinged articulated sections are well known in the art.

For example, WO 92/17093, the teachings of which are incorporated herein in their entirety, discloses a toothbrush in which the head is divided by one or more hinge-forming grooves in the side of the head opposite to the bristle-bearing side into at least two segments that are flexibly and resiliently linked to each other and/or to the toothbrush handle. An elastomeric Material fills each such the groove.

WO 96/02165, the teachings of which ire incorporated herein in their entirety, discloses toothbrushes with resilient, flexible heads, certain embodiments of which are similar to those shown in WO 92/17093. One embodiment has a curved head and is formed by an elastomer-covered thin extension of the handle. A second embodiment is flexible due to hinge-forming grooves in both surfaces of the head, with an elastomeric material filling such grooves, but with bristle tips that terminate in a concave profile in the stress-free configuration The head can also flexibly conform to a convex profile during brushing.

WO 97/07707, the teachings of which are incorporated herein in their entirety, discloses a toothbrush in which the flexibility of the head is concentrated in the tip of the head. The head comprises a substantially rigid base region adjoining the handle on one side and a link region on the opposite side which is linked to the flexibly resilient tip end. The link region may comprise an aperture, space or chasm in the head material, which has an elastomeric material wholly or partially filling the aperture, space or chasm. The tip region may be angled to form a "power tip" construction.

U.S. application Ser. No. 08/762,783, U.S. Pat. No. 5,758,383, issued Jun. 2, 1988 the teachings of which are incorporated herein in their entirety, discloses a toothbrush having a flexible head divided into two segments separated, in some embodiments, by a generally T-shaped groove, which, in longitudinal cross section, extends transversely across the upper or top surface of the head.

While the above publications illustrate toothbrushes with heads of varying degrees of flexibility, each of them fails to provide means to limit the degree of flexibility of the head.

It has also been found that in certain segmented toothbrush heads having multi-component joints having both hard plastic and soft elastomer elements, with a groove-creating, elastomer-filled hinge between the segments, there is a considerable amount of stress placed on the joint when it is forced to flex in such a way that adjacent segments are forced to flex away from each other. This stress can cause delamination of the elastomer, beginning at the extreme outer edge of the groove and continuing along the entire surface of the groove leading to failure of the joint. None of the prior art brushes provides means to improve the adhesion of the elastomer to the walls of the groove.

OBJECTS OF THE INVENTION

It is an object of this invention to provide a toothbrush with a flexible, resilient, angled, segmented brush head, at least one segment of which is designed to flex, under average brushing pressure, to a predetermined extent to result in a flattened position when the brush is subjected to an average brushing force by a typical adult consumer.

It is another object of this invention to provide a toothbrush with a flexible, resilient, angled, articulated brush head, divided into segments by one or more elastomer filled grooves, which includes means to ensure that the elastomer filling each groove is not unduly subject to stress forces that will cause the peeling of the elastomer beginning at the outer edge of the groove and continuing into the groove to thereby separate the elastomer from the hard plastic side walls of the groove.

SUMMARY OF THE INVENTION

According to the invention, an injection molded multi-component toothbrush comprises a bristle-bearing head made of a first component, namely a relatively rigid plastic material which is divided into two or more sections, which, when unstressed, are normally biased to assume an angle with respect to each other to thereby define an articulated head. The two sections of the head have facing ends joined by a thin bridge or hinge section oriented transversely to the longitudinal axis of the brush, the bridge being integral with the two head sections. The upper surface of the bridge section is as close as possible to, and preferably flush with, the upper surface of the head (opposite to the bristle-bearing surface). The space between the two facing ends is filled with a second component, namely a soft elastomer of approximately about 5 to about 30, preferably about 13 to about 30, Shore A hardness. This construction defines an articulated head of limited flex motion, which, when utilized by the average adult brusher, who, it has been determined, applies an average brushing force of 0.5 pounds, flexes to a substantially flattened position. The flexible, segmented head of this invention, in all instances, is resilient, so that when an applied force, as from brushing, is removed, the flexible head returns to its original configuration.

Thus, the above configuration provides a head having a free end segment which flexes during normal use from an initial angle of what has been determined to be approximately 15_to a flat position when brushing flat tooth areas. This configuration also greatly resists flexing beyond the initial 15° angle to an increasingly concave configuration, which is highly desirable because it keeps the bristles from the front and rear portions of the head from engaging each other. However, the brush head will flex to a convex configuration in the event an aggressive brusher exerts more than average pressure while brushing to thereby help avoid or minimize injury to the gums.

The bridge is made of the same resin from which the toothbrush is formed conventionally by injection molding, to produce an integral construction. Typically, polypropylene resins are used to mold the rigid toothbrush bodies, although certain grades of nylon may also be used. The thin bridge permits limited flexing between the two head sections, the head being injection molded in such a way as to result, in the finished multi-component product, in an angle of about 15° between the two head sections. That portion of the head between the two head sections is in the form of a slot running from the bristle-bearing surface of the head nearly to the opposite side of the head, the hinge being as thin as possible consistent with allowing flexibility of the head without breaking during the useful life of the brush. Preferably, the hinge is flush or collinear with the upper surface of the hard plastic skeleton which forms the head and body of the brush. The slot is filled, also by a conventional two component injection molding process, with a soft elastomer to limit the degree of flexing. The construction is such that the head section most remote from the handle, in its final configuration, is tilted at an angle of about 15° with respect to the head section nearest the handle, the latter head section located at one end of the handle.

There are considerable manufacturing efficiencies with having the elastomer material of this invention used in the flex area being the same elastomeric material as that which may be used as a grip material in the handle area. Therefore, a configuration which allows flexing under the loads typically encountered during brushing with materials which are suitable for use as a grip would be desirable.

To achieve the desired ranges of motion indicated above it has been found to be desirable to position the plastic resin bridge between the tip and handle portions of the head as far from the bristle-bearing surface of the head as possible. The upper surface of the bridge is collinear or flush with the upper surface of the hard plastic skeleton of the remainder of the brush.

DETAILED DESCRIPTION OF THE INVENTION

Figure 1:
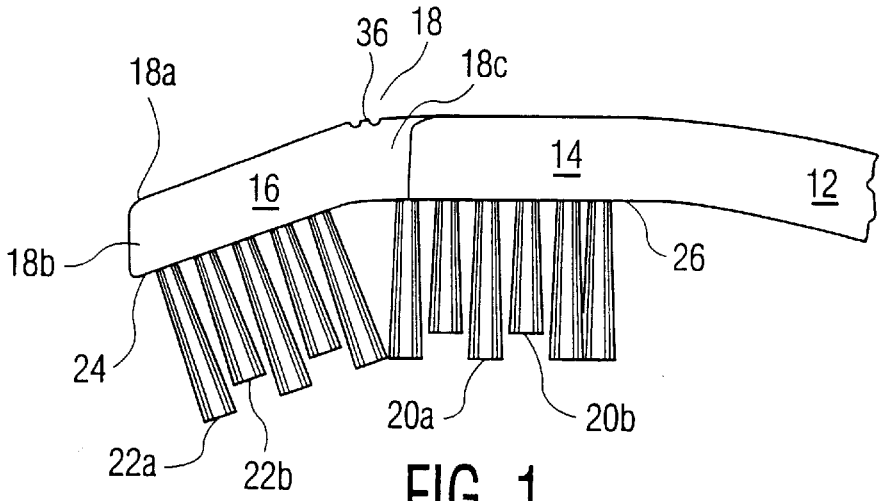
FIG. 1 is a side elevational view illustrating the toothbrush head of this invention according to a first embodiment, the exterior surface of a portion of the head is provided with an elastomeric coating.

The hinge configuration of an angled, flexible head toothbrush according to this invention utilizes information which has been developed through testing indicating that the average adult brushing his or her teeth exerts approximately 0.5 lbs of force. Using this information, a brush has been developed having an angled, flexible, segmented heads the segments created by thin groove-forming hinges bridging the gap between adjacent segments, such that the front ⅓ to ½ of its head, at rest, is configured to be at about a 15° angle from its back portion adjoining the handle. Flexible headed toothbrushes having resiliently linked segments at this angle have been found to offer improved access to difficult to reach areas behind the rear molars and behind the front teeth and to limit the flexibility of the brush in a desirable manner.

While a fixed angle head would offer improved access to the areas mentioned above, it would offer less bristle contact with the flat regions of the teeth (e.g., top surfaces). It is, therefore, desirable to nave the brush flex back to a flattened position when the brush is subjected to the average brushing force of (0.5 lbs.

While the flexing action allows the angled portion to travel 15° to a flattened position under the indicated forces above, for aggressive brushers, the head may be allowed to continue to flex back beyond flat, thereby reducing the negative affects of excessive brushing on the teeth and gums. Moreover, the head should allow little flexing in the opposite direction (i.e., the bristle-bearing surfaces toward each other), as this would tend to cause the front and rear bristles to interengage, which offers no functional benefit.

It has now been determined that to achieve the ranges of motion indicated above, the optimum flexing joint would consist of a hinge or bridge positioned as far away from the bristle surface as possible, which hinge or bridge should be as thin as possible. Polypropylene hinges are known in the art, and are generally recommended to be 0.005"–0.025" thick. By filling the area beneath the hinge with a soft elastomer of approximately about 5 to about 30, preferably about 13 to about 30, Shore A hardness, the desired ranges of flexibility can be achieved. With the hinge placed opposite the bristle surface, when one pushes the tip of the brush down (undesirable), the elastomer is subject to compression forces. As elastomers resist compression, however, this configuration prevents undesirable downward motion. At the same time, this configuration permits flexing in the opposite direction, as no elastomer is being subjected to compression as a result of the flattening of the brush head.

Thus, the configuration claimed herein provides a head which flexes during normal use from an initial angle of approximately 15° to a flat position when an adult brushes flat tooth areas and exerts an average brushing force of 0.5 lbs. This configuration also greatly resists flexing beyond the initial 15°, which is highly desirable to keep the bristles from the front and rear portion of the head from engaging each other.

Figure 2:
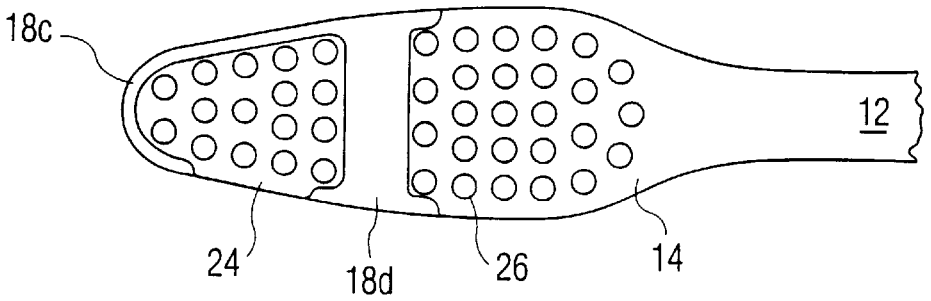
FIG. 2 is a bottom plan view of the toothbrush head shown at FIG. 1.
Figure 3:
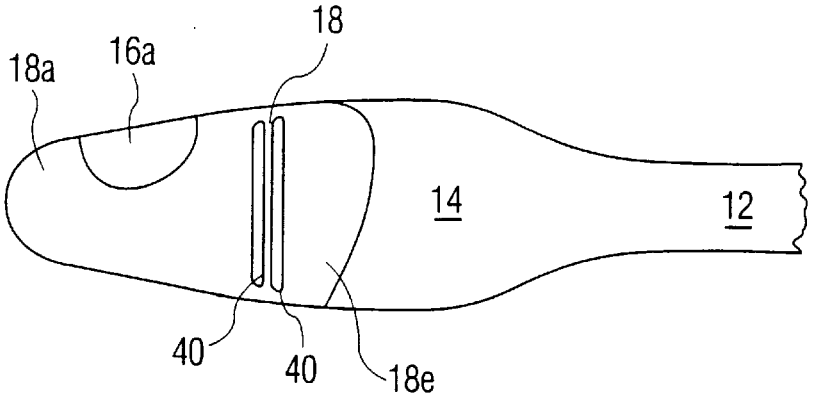
FIG. 3 is a top plan view of the toothbrush head shown at FIG. 1.

Referring now to FIG. 1, a side elevational view of a toothbrush embodying the features and construction of this invention is shown in a vertical position, with a portion of the handle designated as 12. While not completely shown, it will be understood that the handle extends horizontally and has a longitudinal axis. That portion of the head nearest the handle is designated as (rear) section 14 and is collinear with the handle, while that portion of the head most remote from the handle is designated as (front) section 16. An elastomer section or joint between facing ends of sections 14 and 16 is denoted generally as 18. However, as FIGS. 1–3 illustrate an embodiment wherein the elastomer also covers much of the top (18*a*), side (18*b*), lower peripheral edge (18*c*), and lower groove (18*d*) surfaces of the brush to thereby act as an elastomeric bumper around such surfaces of the free end of the brush in a known manner, the joint construction will be discussed below in greater detail. A plurality of tufts of long bristles 20*a* and short bristles 20*b* extends at generally right angles to section 14, while a similar plurality of cufts of long bristles 22*a* and short bristles 22*b* extends at right angles from section 16. Tufts of bristles 22*a* and 22*b* are thus at generally right angles to lower surface 24 of head section 16, while tufts of bristles 20*a* and 20*b* are generally perpendicular to lower or bottom surface 26 of head section 14. It will be recognized by those skilled in the art, that the bristles are not required to be perpendicular to the plane of the bottom of the head but may assume other angles with respect thereto.

As seen best in FIGS. 1 and 3, the middle of the elastomer coated joint section 18 includes an integral ridge 36 of elastomer and a groove 40 on either side thereof. As seen best in FIG. 3, a portion of the upper surface of hard plastic skeleton 16 is designated 16*a* and is flush with the level of elastomer coating 18 on top surface of the brush. As best seen in FIG. 2, the elastomer coating extends around the sides of the brush and down to the bottom surface along the peripheral edges 18*c*. It will be understood by those skilled in the art that such extension of the elastomer coating to form a bumper is a feature unnecessary to the practice of this invention and is well known to the art, as demonstrated by German Patent DE 36 28 722 and European Application 0 310 482.

Figure 4A:
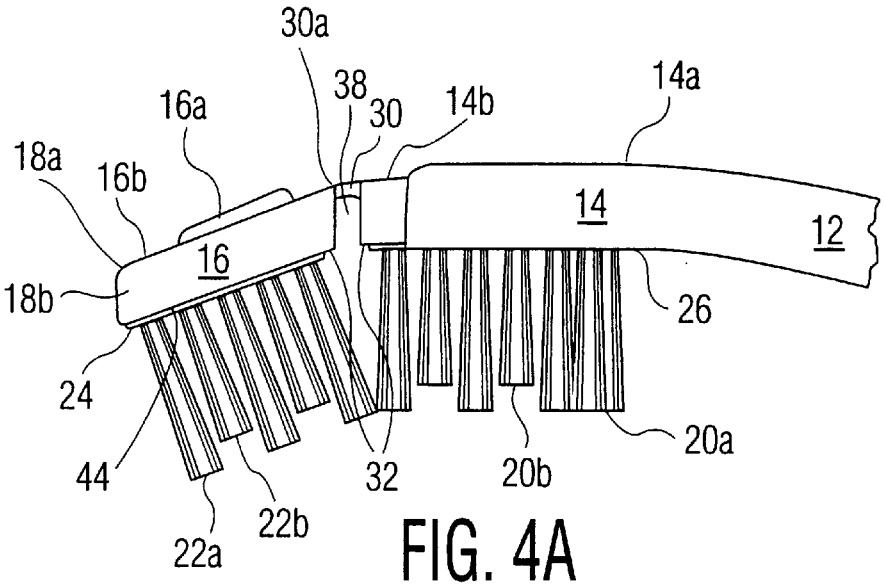
FIG. 4A is a side elevational view of the toothbrush head shown at FIG. 1 without elastomeric material.

Referring now to FIG. 4*a*, the brush of FIGS. 1–3 is shown without the elastomeric coating 18. The relatively hard (compared to the elastomer) plastic brush body or skeleton is comprised of front section 14 having a first upper surface 16*a* and a second upper surface 16*b*, 16*b* being lower than 16*a*; rear section 14 having a first upper surface 14*a* and a second upper surface 14*b*, 14*b* being lower than 14*a*; and bridge 30, the upper surface of which, 30*a*, is collinear with upper surfaces 14*b* and 16*b*. The front section 16 and the rear section 14 are separated by a generally inverted T-shaped groove 38, in longitudinal cross section, which T-shaped groove begins at the lower surface of bridge 30 and is thus located between sections 14 and 16 and extends to lower surfaces 24, 26 where it terminates at the extreme outer edge in flanges 32. Bridge or zone 30 is typically of a thickness between 20 and 30 thousandths of an inch. The handle 12, head sections 14, 16, and bridge 30 are typically molded from a plastic or resin such as polypropylene, although certain grades of nylon polymers may also be used. Preferred polpropylene resins include Huntsman General Purpose Homopolymer No. 5520 and Hostalen Polpropylene PPR 1042 Copolymer.

It has been found that there is a significant amount of stress on the joint between the rubber and the plastic wall of the groove in the hinge area. The joint relies on fusion between the elastomer and the harder polypropylene plastic toothbrush body material. This fusion occurs as a result of the injection under pressure of the elastomer, at a temperature greater than the melting point of the elastomer, onto the plastic body part. Ideally, a chemical bond is formed where the two materials meet, due to a thin surface layer of polypropylene, for example, melting and fusing with the molten elastomer.

While it is possible to produce toothbrushes with good surface fusion between the rigid plastic and the elastomer by use of a significant amount of process control, primarily controlling the temperature of the rigid plastic and the incoming molten elastomer. Even in acceptable samples, patches have been found where the bond was not as strong as in other area. It will be obvious to those skilled in the art, that assuring a good joint is critical to the long term performance and safety of a flexible head, two component toothbrush.

We have now found that this joint can be improved by use of a mechanical configuration to be discussed below.

Typically, when de-lamination occurs, it begins along the extreme outer edge of the groove at the point where the elastomer and the rigid plastic join. Under extreme stress, this de-lamination then spreads upward along the entire face of the groove, leading to failure of the fusion bond. By the provision of a relief flange at each extreme outer edge of the groove, which is the point which undergoes the greatest stress, we have found that the stress can be redirected along the outer or leading edge, to thereby result in an improved joint.

The generally inverted T-shaped groove is filled with a resilient and soft thermoplastic elastomer. The inverted T-shaped groove has two symmetrical flange portions 32, each extending towards respective groups of tufts of bristles 20 and 22. The thermoplastic elastomer which forms elastomeric sections 18–18*e* may be a thermoplastic vulcanate (TPV) consisting of a mixture of polypropylene and EPDM (ethylene propylene diene monomers) (Santoprene brand), or Vyram (brand), another TPV consisting of a mixture of polypropylene and natural rubber, both Santoprene and Vyram (brands) being elastomers marketed by Advanced Elastomer Systems. A preferred elastomer includes Kraton, a brand of styrene block copolymer (SBC) marketed by Shell, and Dynaflex G 2706 (brand), a thermoplastic elastomer marketed by GLS Corporation and which is made with Kraton (brand) polymer. These and other suitable elastomers have, typically, a Shore A hardness of from about 5 to about 30, with about 20 being a preferred hardness. However, it must be kept in mind that colorants used to impart color to the elastomers have an effect on their hardness, as the colorants consist of polypropylene pellets which are generally of greater hardness than the elastomers preferred herein. Thus, the Shore A hardness must be determined for the colored elastomers desired to be used. Grooves 40, on the top surface of the composite head, extend on both sides of raised rib or ridge 36, and border sections 32. FIG. 3 further illustrates the construction. It is seen that elastomer section 18 spans the width of the head sections and extends at 18*e* into head section 14.

It will be noted that the brushes Illustrated in FIGS. 1–4B comprise integral head and handle portions forming a "skeleton" that is made by a conventional injection molding process, wherein the skeleton may be made from a relatively rigid, compared to the elastomer, plastic material, such as nylon or polypropylene, wherein relief areas are provided to enable the injection molding of the elastomer, by conventional two-component injection molding processes, used to form not only the joint, but a soft bumper covering portions of the top, sides, and lower surfaces of the free end of the brush. The result is the formation of a two component head which has a relatively smooth outer surface to avoid entrapment of food particles while brushing, to reduce or eliminate trauma and injury to the gums, to avoid an undesirable mouth feel, and to present an esthetically pleasing visual effect. However, the objectives of the invention can be met by a brush, as shown in FIG. 7, in which the elastomer is limited to the joint area.

Figure 4B:
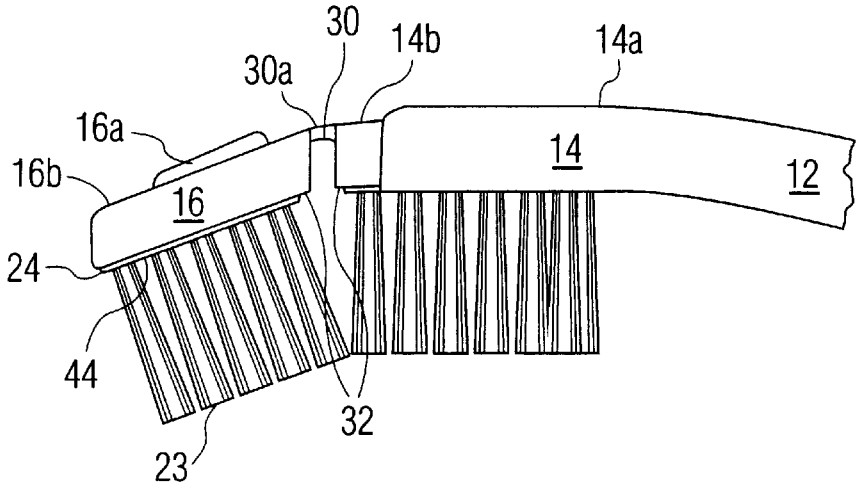
FIG. 4B is a side elevational view of a second embodiment of the toothbrush head of this invention, similar to FIG. 4A without elastomeric material, but wherein the bristle tips in each head segment terminate in the same plane.
Figure 4C:
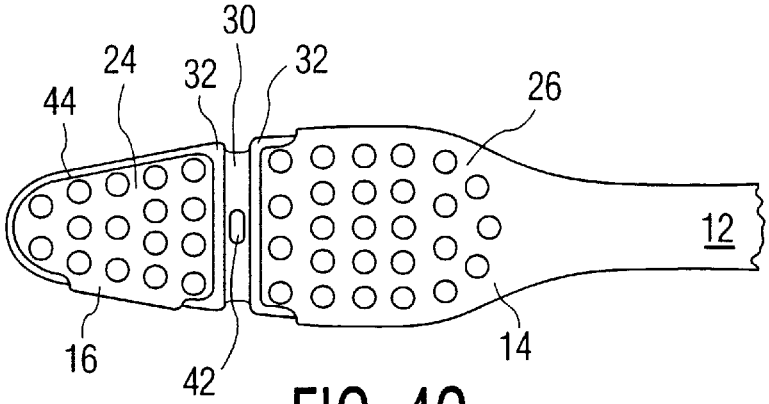
FIG. 4C is a bottom plan view of the toothbrush head shown at FIGS. 1–3 without the elastomer coating.
Figure 5A:
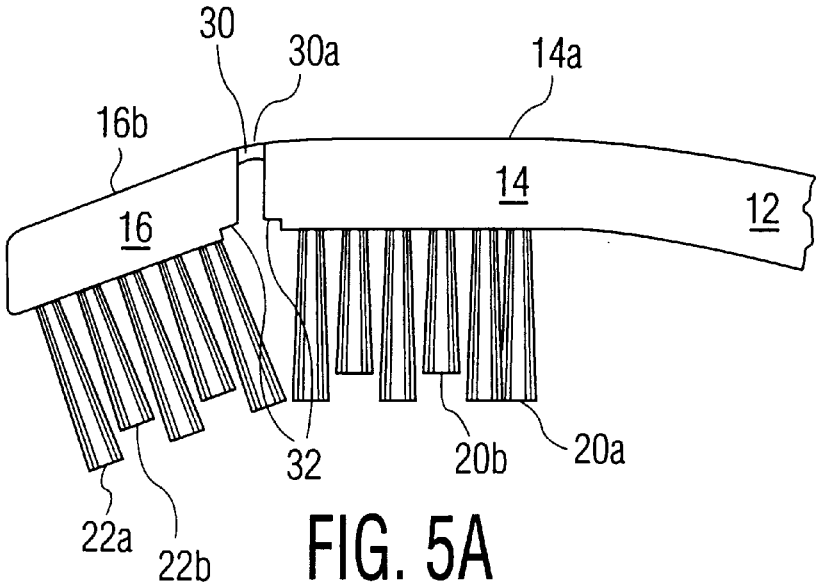
FIG. 5A is a side elevational view of a third embodiment of the toothbrush head of this invention, similar to FIG. 4A without elastomeric material, but with flanges only at the edges of the groove on the bristle-bearing surface.
Figure 5B:
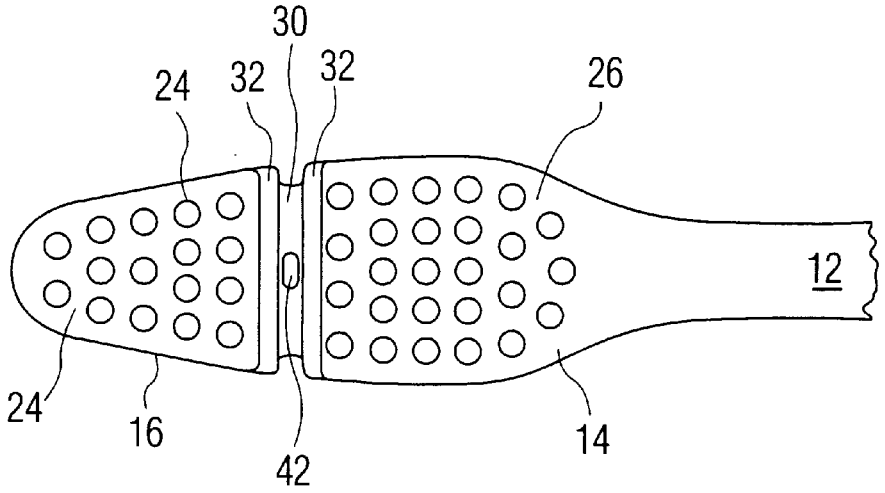
FIG. 5B is a bottom plan view of the toothbrush head shown at FIG. 5A without the elastomer coating.

Referring now to FIG. 5A, the brush is shown without the elastomeric coating 18 and without the relief areas illustrated in FIGS. 4A and 4B, the brush body and head being of all comparatively rigid plastic and only the inverted T-shaped groove 38 is provided for the elastomeric material. Again, segment 16 is at an angle of about 15° to segment 14. Generally inverted T-shaped groove 38, in longitudinal cross section, begins at the lower surface of bridge 30 and extends down to lower surfaces 24, 26 where it terminates at its extreme outer edge in flanges 32. As before, inverted T-shaped groove 38 is filled with a resilient and soft thermoplastic elastomer. FIG. 5B illustrates a bottom, plan view of the brush of FIGS. 1–3 without the elastorneric coating, wherein bridge 30 is provided with hole 42 through which molten elastomer 18 may flow to groove 38, including peripheral lower edge area 44 where the elastomeric bumper extends to the lower surface 24 of section 16.

Figure 6A:
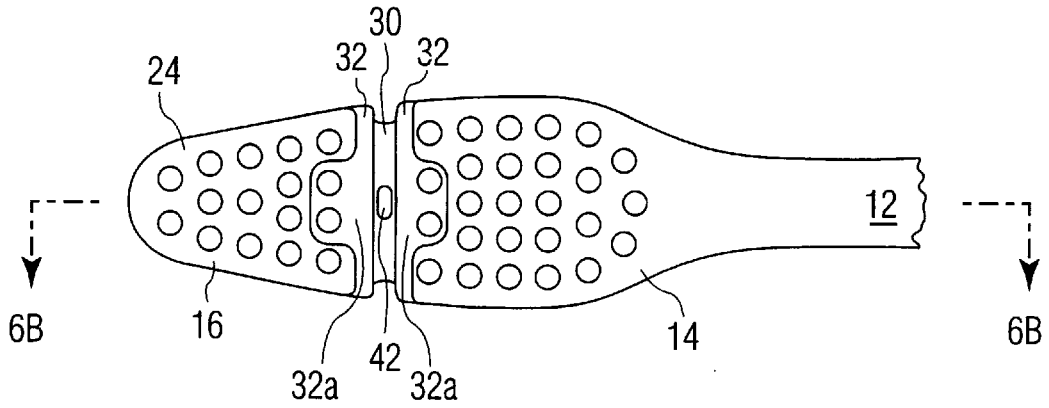
FIG. 6A is a bottom plan view of a fourth embodiment of the toothbrush head of thus invention, similar to FIG. 5A without elastomeric, material, but with extra large flanges only at the edges of the groove on the bristle-bearing surface.
Figure 6B:
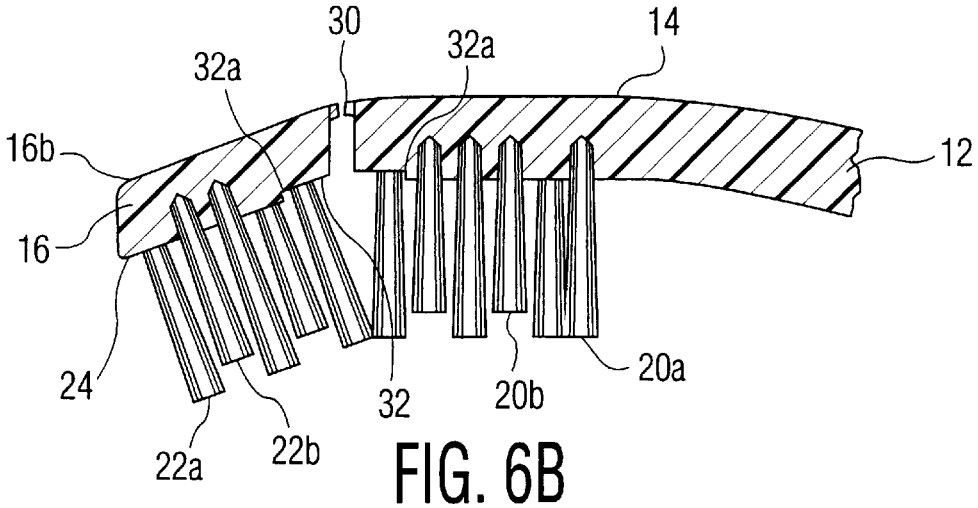
FIG. 6B is a cross-sectional view taken along line 6B—6B of FIG. 6A of the toothbrush head shown at FIG. 6A.
Figure 6C:
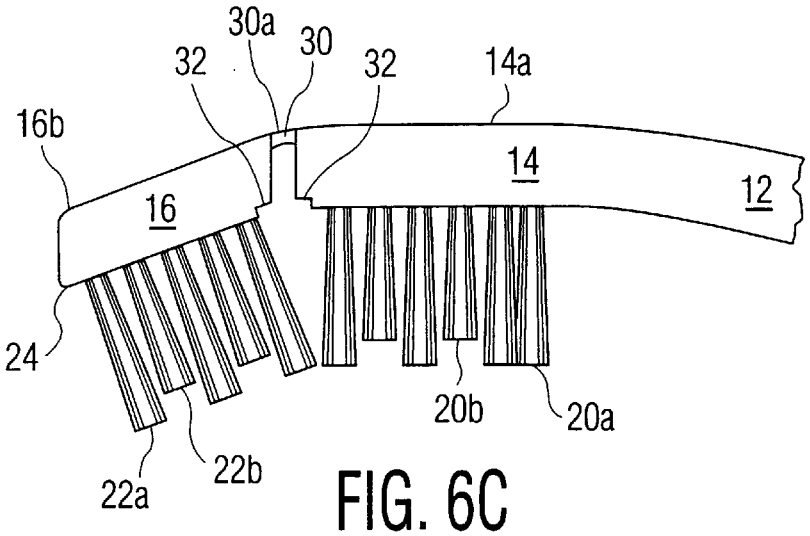
FIG. 6C is an exterior side elevational view of the toothbrush head shown at FIGS. 6A and 6B without elastomeric material.

Referring now to FIG. 6A, an alternate embodiment is illustrated wherein lower flanges 32 are extra large to re-direct the shear stresses over an even larger area to thereby improve the adhesion between the elastomer and the rigid plastic walls of the groove, and FIG. 6B is a cross-sectional view of the brush of FIG. 6A taken along line 6B—6B, which clearly illustrates the enlarged flange area. FIG. 6C is a side elevational view of the brush of FIGS. 6A and 6B.

Figure 7:
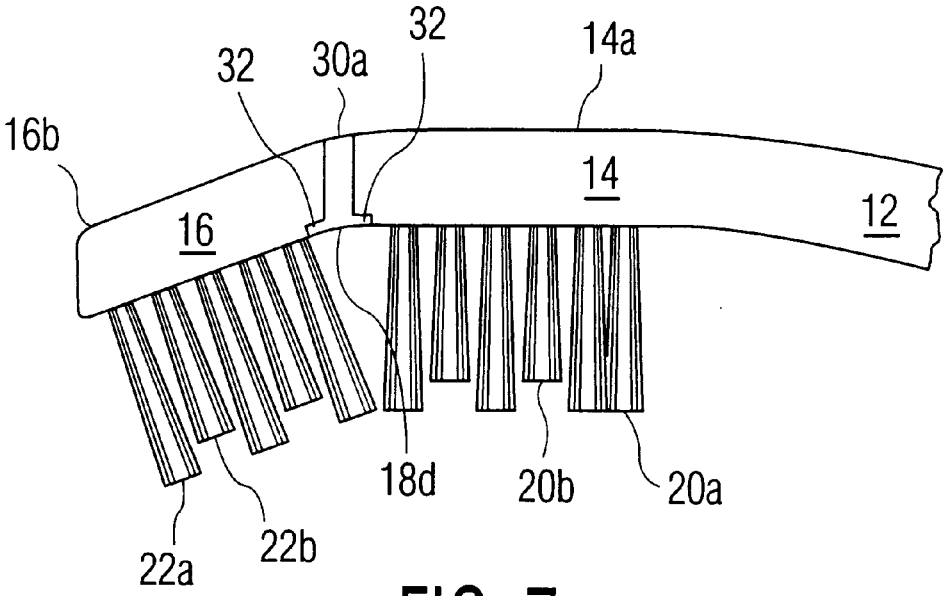
FIG. 7 is an exterior side elevational view of the toothbrush head shown at FIGS. 6A–6C with elastomeric material.

Referring now to FIG. 7, another embodiment of the brush is shown in which the elastomeric material is present only in the hinge area, including the flanges 32. Hinge 30 is collinear with upper surfaces 16*b* and 14*b*, and front head section 16 is at a 15° angle with respect to rear head section 14.

In the normal configuration of the head, it is seen that head section 16 is tilted with respect to head section 14 at an angle, determined by us to be about 15° optimally. Thus, a force exerted on the brush during brushing is required to tilt section 16 if it is to be more nearly or completely aligned with section 14 along the longitudinal axis of the brush. The two head sections are molded in their angled configuration as shown at FIG. 1, with the elastomer then added during a second stage in a conventional dual component injection molding process. It will be appreciated, however, that the skeleton may be molded at an angle slightly greater than 15° or slightly less than 15° because of the tendency of the elastomer to shrink after molding. This shrinkage can alter the angle of the tip, the amount of which is controlled by the configuration of the elastomer about the hinged area. Hence, the flexible tip segment of the skeleton might be molded at an 18° angle in order to achieve a final 15° angle in the composite two component brush.

Figure 8:
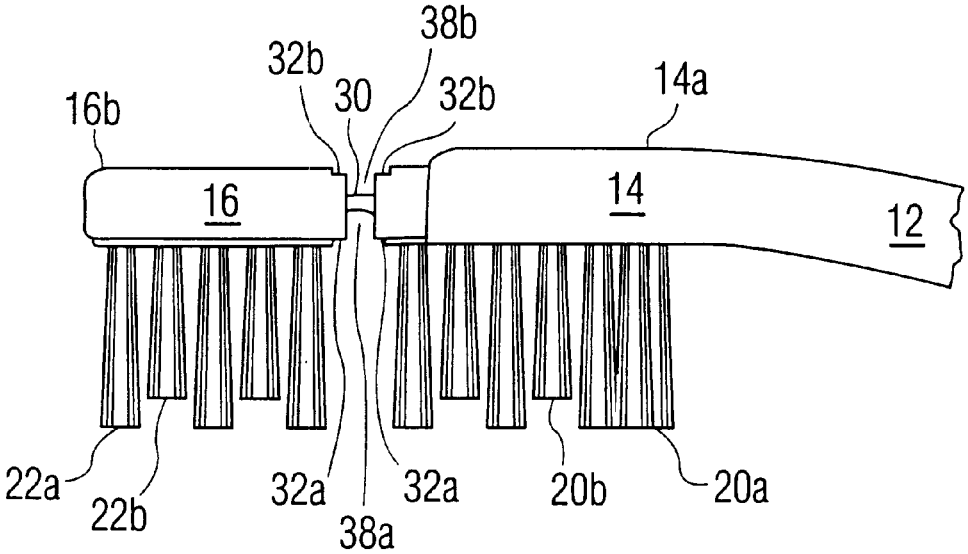
FIG. 8 is an exterior side elevational view of another toothbrush heads without elastomeric coating, designed to flex easily to a convex or concave configuration, wherein the bridge between the head segments is midway between the upper and lower head surfaces, with flanges at each extreme outer edge of each of the upper and lower grooves to be filled with elastomer during the injection molding process.

Referring now to FIG. 8, another toothbrush head is shown, without elastomeric coating. By virtue of the placement of bridge 30 midway between the upper and lower head surfaces, head segment 16 can flex more easily to either a convex or concave configuration and relief flanges 32*a* and 32*b* are provided at each extreme outer edge of each of the upper 38*a* and lower 38*b* grooves to be filled with elastomer during the injection molding process. In this embodiment, as the lower surfaces of the head segments flex toward each other, end the upper surfaces of the head segments flex away from each other, upper relief flanges 32*b* help provide resistance to peel stresses tending to cause delamination of the elastomer from the rigid brush skeleton. Similarly, as the lower surfaces of the head segments flex away from each other, and the upper surfaces of the head segments flex toward each other, lower relief flanges 32*a* help provide resistance to peel stresses tending to cause similar delamination.

Many toothbrushes available in the marketplace today are "dual component," by which is meant that an elastomeric material is used to a greater or lesser extent, particularly in the finger grippig portion of the brush. The method of manufacture of such dual component brushes by injection molding is thus exceedingly well known in the art today. The toothbrushes according to the present invention may be made by use of such conventional dual component technology. For example, in accordance with a first method of manufacturing brushes according to the present invention, the elastomeric material may be introduced into the head area from the hand grip area via a molded-in channel (assuming a hand grip area is present). Alternatively, according to known technology, the elastomer could be introduced into the head area via a second injection point or gate located at the head, thereby eliminating the need for a molded-in channel. A means and method for accomplishing this will be found in PCT application WO 94/05183 assigned to Jordan AS of Norway. The head may then be tufted using conventional staple technology.

In accordance with another method of manufacturing brushes according to the present invention, the handle and elastomer for the grip and the head areas are molded using a three-shot molding technique. The elastomer is introduced into the head area separately from the hand grip area. This process is especially useful if the elastomer for the head section of the brush and the hand grip section are different elastomeric materials, such as elastomers having two different Shore hardness values. For example, in some circumstances, it may be desired to use a softer elastomer for the head area than for the hand grip portion of the brush. As above, the head may then be tufted using conventional staple technology. A complete description of methods and machines to tuft the resiliently flexible brushes disclosed herein and then trim and end round the bristles thereof will be found in application Ser. No. 08/881,735 filed on even date herewith and now U.S. Pat. No. 5,863,102, issued Jan. 26, 1999.

The term toothbrush, as used herein, includes brush heads for use in either detachable-headed manual brushes or electric or battery operated brushes, in which cases the stem portions thereof are equivalent to the toothbrush handles referred to herein.

While particular embodiments of the present invention have been illustrated and described, it will be obvious to those skilled in the art that is not to be limited thereto and that variations and modifications can be made without departing from the scope of the present invention and the appended claims are intended to cover all such modifications within the scope and spirit of the invention.

What is claimed is:

1. An injection molded toothbrush of limited flexibility having a rigid handle and an articulate head disposed along a longitudinal axis of the toothbrush, said head having a back end adjoining said handle and a free tip end remote from the back end, said head being divided into at least two rigid sections, the section at said free tip end capable of resiliently flexing with respect to the other of said sections, another one of said sections being joined to said handle at the back end of said head, said section at said free tip end being disposed at a preselected angle relative to said other said head sections such that under normal brushing pressure said head flexes such that said at least two head sections bend relative to each other toward a substantially flattened alignment along said longitudinal axis of the toothbrush, said at least two head sections each having an upper surface and a bottom surface, said at least two sections having respective longitudinally spaced ends facing each other, said spaced ends having an upper and lower edge, the upper edge of said spaced ends being joined by a thin bridge formed integrally with said two sections, said thin bridge having an upper surface and a bottom surface, said upper surface of said thin bridge being located collinearly with the upper surface of said head, a groove created between said spaced ends, said groove having an upper portion which terminates at the bottom surface of said thin bridge, said groove having a lower termination located adjacent to the lower edge of said spaced ends, a plurality of tufts of bristles extending from said bottom surface of each head section, an elastomer section located between said spaced ends to thereby form a composite head, said elastomer having a Shore A hardness of about 5 to about 30, said elastomer section extending at least from the bottom surface of said thin bridge to the lower termination of said groove.

2. The toothbrush of claim 1 wherein there are two rigid head sections, a first head section being at said free tip end joined by said thin bridge to a second head section which is integral with said rigid handle; said head sections having upper surfaces with raised portions, sides and lower bristle containing surfaces; said lower bristle containing surfaces having a peripheral edge, said peripheral edge contains a lower groove; said thin bridge, and said upper surfaces, sides, and lower groove of said first head section and a portion of said upper surfaces, sides and lower groove of said second head section having an elastomeric bumper thereabout, said raised portion of said upper surface of said first head section extending through said elastomeric bumper, said raised upper portion of said second head section being located between said elastomeric bumper and said handle; said elastomeric bumper being of equal height to the raised portions of said first and second head sections.

3. The toothbrush of claim 2 wherein said elastomer section is generally of inverted T shape in longitudinal cross section.

4. The toothbrush of claim 3 wherein the elastomer covering the top surface of said thin bridge includes transversely oriented parallel grooves and an integral ridge between said parallel grooves.

5. The toothbrush of claim 1 wherein said preselected angle is about 15°.

6. An injection molded toothbrush of limited flexibility having a rigid handle and an articulated head disposed along a longitudinal axis of the toothbrush, said head having a back end adjoining said handle and a free tip end remote from the back end, said head being divided into at least two sections, the section at said free tip end capable of resiliently flexing with respect to the other of said sections, another one of said sections being joined to said handle at the back end of said head, said section at said free tip end being disposed at a preselected angle relative to said other said head sections such that under normal brushing pressure of 0.5 pounds said head flexes such that said at least two head sections bend relative to each other toward a substantially flattened position, said at least two head sections each having an upper surface and a bottom surface, said at least two sections having respective longitudinally spaced ends facing each other, said spaced ends joined by a thin bridge formed integrally with said two sections, said thin bridge having an upper surface and a bottom surface, said upper surface of said thin bridge being located collinearly with the upper surface of said head, a groove created between said spaced ends, said groove having an upper portion terminating at the bottom surface of said thin bridge, said groove having a lower portion terminating in a flanged area extending into the bottom surface of each of said head sections, each of said head sections having a plurality of tufts of bristles extending from said bottom surface of each head section, a peel-resistant elastomer section located between said spaced ends to thereby form a composite head, said elastomer having a Shore A hardness of about 5 to about 30, said elastomer section extending at least from the bottom surface of said thin bridge to the flanged area of said groove extending into the bottom surface of each of said head sections.

7. The toothbrush of claim 6 wherein there are two rigid head sections, a first head section being at said free tip end joined by said thin bridge to a second head section which is integral with said rigid handle; said head sections having upper surfaces with raised portions, sides and lower bristle containing surfaces; said lower bristle containing surfaces having a peripheral edge, said peripheral edge contains a lower groove; said thin bridge, and said upper surfaces, sides, and lower groove of said first head section and a portion of said upper surfaces, sides and lower groove of said second head section having an elastomeric bumper thereabout, said raised portion of said upper surface of said first head section extending through said elastomeric bumper, said raised upper portion of said second head section being located between said elastomeric bumper and said handle; said elastomeric bumper being of equal height as the raised portions of said first and second head sections.

8. The toothbrush of claim 7 wherein said elastomer section is generally of inverted T shape in longitudinal cross section.

9. The toothbrush of claim 8 wherein the elastomer covering the top surface of said thin bridge includes transversely oriented parallel grooves and an integral ridge between said parallel grooves.

10. The toothbrush of claim 6 wherein said preselected angle is about 15°.

11. An injection molded toothbrush of limited flexiblity having a rigid handle and an articulated head disposed along a longitudinal axis of the toothbrush, said head having a back end adjoining said handle and a free tip end remote from the back end, said head being divided into at least two sections, the sections capable of resiliently flexing with respect to each other under normal brushing pressure, said head sections having an upper surface and a bottom surface, said at least two sections having respectively longitudinally spaced ends facing each other, said spaced ends joined by a thin bridge formed integrally with said two sections, said thin bridge having an upper surface and a bottom surface, a groove created by said bridge between said spaced ends terminating at the bottom surfaces of said sections, a flanged area is located at the intersection of said spaced ends and the bottom surface of each head section, said flanged area extending into said bottom surface of each head section, a plurality of tufts of bristles extending from said bottom surface of each head section, a peel-resistant elastomer section located between said spaced ends to thereby form a composite head, said elastomer section extending at least from the bottom surface of said thin bridge to the flanged area of said groove extending into the bottom surface of each of said head sections, whereby said elastomer section is deformed during brushing whenever said at least two head sections bend relative to each other.

* * * * *